United States Patent [19]

Richardson, Jr.

[11] Patent Number: 4,884,955

[45] Date of Patent: Dec. 5, 1989

[54] SCROLL COMPRESSOR HAVING OIL-ACTUATED COMPLIANCE MECHANISM

[75] Inventor: Hubert Richardson, Jr., Brooklyn, Mich.

[73] Assignee: Tecumseh Products Company, Tecumseh, Mich.

[21] Appl. No.: 193,416

[22] Filed: May 12, 1988

[51] Int. Cl.[4] ..... F04C 18/04; F04C 27/00; F04C 29/02

[52] U.S. Cl. ..... 418/1; 418/55; 418/57

[58] Field of Search ..... 418/1, 55, 57, 88, 94; 277/27, 95

[56] References Cited

U.S. PATENT DOCUMENTS

| | | | |
|---|---|---|---|
| 2,013,499 | 9/1935 | Meckenstock | 277/95 |
| 2,777,688 | 1/1957 | Ehrlich et al. | 277/95 |
| 3,986,799 | 10/1976 | McCullough | 418/55 |
| 3,994,633 | 11/1976 | Shaffer | 418/55 |
| 4,457,676 | 7/1984 | Hiraga | 418/55 |
| 4,522,575 | 6/1985 | Tischer et al. | 418/55 |
| 4,600,369 | 7/1986 | Blain | 418/55 |
| 4,655,697 | 4/1987 | Nakamura et al. | 418/55 |
| 4,708,607 | 11/1987 | Hayano et al. | 418/55 D |
| 4,743,181 | 5/1988 | Murayama et al. | 418/55 |

FOREIGN PATENT DOCUMENTS 61-8407 1/1986 Japan .

*Primary Examiner*—John J. Vrablik

*Attorney, Agent, or Firm*—Albert L. Jeffers; John F. Hoffman; David L. Ahlersmeyer

[57] ABSTRACT

A scroll-type hermetic compressor is disclosed including within a hermetically sealed housing a fixed scroll member, an orbiting scroll member, a main bearing frame member, and a crankshaft. An oil sump is located in a discharge pressure chamber in the housing. The frame member and fixed scroll member define a suction pressure chamber in which the orbiting scroll member is disposed. The crankshaft includes a plate portion disposed between the orbiting scroll member and a thrust surface of the frame. Flexible annular seals are disposed within respective interfaces between the orbiting scroll member bottom surface and the plate portion top surface, and between the plate portion bottom surface and the frame thrust surface. The seals provide sealing between a radially inner, oil-filled discharge region and a radially outer suction region, and actuate to compensate for axial space in the interfaces.

33 Claims, 6 Drawing Sheets

SCROLL COMPRESSOR HAVING OIL-ACTUATED COMPLIANCE MECHANISM

BACKGROUND OF THE INVENTION

The present invention relates generally to a hermetic scroll-type compressor and, more particularly, to such a compressor having an axial compliance mechanism, wherein an axial force acts on an orbiting scroll member to bias it toward a fixed scroll member for proper sealing therebetween during compressor operation. More specifically, the present invention pertains to such an axial compliance mechanism in which respective regions of discharge and suction pressure act on the bottom surface of the orbiting scroll member, and sealing is provided between the respective pressure regions.

A typical scroll compressor comprises two facing scroll members, each having an involute wrap, wherein the respective wraps interfit to define a plurality of closed pockets. When one of the scroll members is orbited relative to the other, the pockets travel between a radially outer suction port and a radially inner discharge port to convey and compress the refrigerant fluid.

It is generally believed that the scroll-type compressor could potentially offer quiet, efficient, and low-maintenance operation in a variety of refrigeration system applications. However, several design problems persist that have prevented the scroll compressor from achieving wide market acceptance and commercial success. For instance, during compressor operation, the pressure of compressed refrigerant fluid at the interface between the scroll members tends to force the scroll members axially apart. Axial separation of the scroll members causes the closed pockets to leak at the interface between the wrap tips of one scroll member and the face surface of the opposite scroll member. Such leakage causes reduced compressor operating efficiency and, in extreme cases, can result in an inability of the compressor to operate.

In most scroll compressors, the fixed and orbiting scroll members are precisely machined so that the height of the respective involute wrap elements are substantially equal, thereby insuring proper sealing between the wrap tips and face surfaces. In such a compressor, it is often the practice to manufacture and assemble the compressor so that the orbiting scroll member is initially in sealing contact with the fixed scroll member. This may be accomplished by holding tight dimensional tolerances on various machined compressor components, e.g., fixed and orbiting scroll members, frame member, crankshaft, orbiting scroll member drive mechanism. A primary disadvantage of this approach is the difficulty and expense associated with trying to achieve close stack-up tolerances with a plurality of associated parts.

Alternatively, the scroll members may be preloaded toward each other to facilitate sealing contact, i.e., with a spring mechanism or resilient seal means. When the scroll members are initially in sealing contact with one another, high frictional forces between the scroll members cause difficulty during compressor start-up. Furthermore, an expensive thrust bearing may be required to bear the separating force between the fixed and orbiting scroll members.

In an effort to avoid the manufacturing and operational problems associated with scroll compressors wherein the fixed and orbiting scroll members initially sealingly contact one another, axial compliance mechanisms have been developed in which the orbiting scroll member is initially spaced from the fixed scroll member and then moves axially toward the fixed scroll member to sealingly engage after compressor start-up. In U.S. Pat. No. 4,645,437, issued to Sakashita et al., an annular chamber containing gaseous refrigerant at discharge pressure is exposed to the bottom surface of the orbiting scroll member to cause it to shift slightly upwardly. A pair of radially inner and outer seal rings move axially upwardly along respective tapered chamber walls so as to remain in sealing contact with the bottom surface of the orbiting scroll member. Accordingly, the annular channel is initially sealed and remains sealed during axial movement of the orbiting scroll compressor.

One disadvantage of all the aforementioned axial compliance mechanisms is the fact that the compressor experiences loading very quickly upon start-up, due to either initially sealed compression pockets or an axial compliance mechanism that is quickly actuated by compressed gaseous refrigerant. If loading occurs prior to the crankshaft bearings being lubricated with oil, premature failure of the bearings may result. Also, many prior art scroll compressors, wherein the orbiting scroll member is permitted to move axially, experience excessive oil rates, i.e., the percentage of lubricating oil entrained in the refrigerant fluid. This is caused in part by the fact that in the differential pressure oil pump system commonly used in the prior art scroll compressors, axial displacement of the orbiting scroll member provides less restriction for flow of lubricating oil from discharge pressure regions to suction pressure regions. Furthermore, despite prior art attempts to seal between respective regions of gaseous refrigerant at discharge and suction pressures, sealing of gaseous refrigerant remains a difficult task and results in a "dry" seal that is less effective at higher compressor operating speeds.

The present invention is directed to overcoming the aforementioned problems associated with scroll compressor axial compliance mechanisms, wherein it is desired to provide a reliable seal between respective regions of discharge and suction pressure on the bottom surface of the orbiting scroll member, despite axial movement of the orbiting scroll member toward the fixed scroll member.

SUMMARY OF THE INVENTION

The present invention overcomes the disadvantages of the above-described prior art scroll compressor by providing an improved axial compliance mechanism wherein sealing is provided between respective regions of discharge and suction pressure acting on the bottom surface of the orbiting scroll member by a seal that is actuated by the flow of oil from the discharge pressure region to the suction pressure region. The seal is capable of compensating for an axial space created by axial movement of the orbiting scroll member toward the fixed scroll member.

Generally, the invention provides, in one form thereof, a scroll-type compressor comprising a fixed scroll member attached to a frame member, wherein the frame member includes a thrust surface that faces the fixed scroll member and is spaced therefrom a fixed distance. An orbiting scroll member is disposed intermediate the fixed scroll member and the thrust surface, and is capable of axial movement toward the fixed scroll member in response to an axial compliance force. The axial compliance force is provided by a radially inner discharge pressure region and a radially outer suction pressure region disposed intermediate the orbiting scroll member and the thrust surface. The discharge pressure region and the suction pressure region are sealingly separated by a flexible annular seal that is actuated by radially outward flow of oil from the discharge pressure region to the suction pressure region. The seal also compensates for the axial space resulting from axial movement of the orbiting scroll member toward the fixed scroll member.

More specifically, the invention provides, in one form thereof, a fixed scroll member attached to a frame member within a hermetically sealed housing. An orbiting scroll member is disposed intermediate the fixed scroll member and a thrust surface of the frame member. A rotatable crankshaft is journalled in a main bearing in the frame member and includes a crank portion journalled in a crank bearing of the orbiting scroll member to impart orbiting motion thereto. The crankshaft also includes a radially extending plate portion disposed intermediate the orbiting scroll member and the thrust surface. An annular seal is provided within a top interface defined intermediate the orbiting scroll member and the plate portion, and within a bottom interface defined intermediate the plate portion and the thrust surface. The annular seals each define a radially inner discharge pressure region and a radially outer suction pressure region within the top and bottom interfaces, respectively. A centrifugal oil pump on the end of the crankshaft draws lubricating oil from an oil sump in the housing for delivery to the main bearing and the crank bearing prior to delivery to the discharge pressure regions in the top and bottom interfaces.

An advantage of the scroll compressor of the present invention is the provision of an axial compliance mechanism that is capable of operating in the presence of, and compensating for, an axial space resulting from axial movement of the orbiting scroll member toward the fixed scroll member, thereby lowering the cost to manufacture the compressor by permitting larger machining tolerance for the component parts and stack-up tolerances during assembly.

Another advantage of the scroll compressor of the present invention is the provision of an axial compliance mechanism that is not fully actuated until after crankshaft bearings are lubricated, thereby preventing premature failure of bearings caused by loading of the crankshaft when the bearings are dry.

A further advantage of the scroll compressor of the present invention is the provision of an axial compliance mechanism that permits higher compressor operating speeds while maintaining an effective seal between regions of high and low pressure acting on the bottom surface of the orbiting scroll member.

Another advantage of the scroll compressor of the present invention is that oil is permitted to reach the scroll wrap elements prior to the orbiting scroll member being fully biased against the fixed scroll member by the axial compliance mechanism.

Yet another advantage of the scroll compressor of the present invention is the provision of a seal, to seal between regions of high and low pressure on the bottom surface of the orbiting scroll member, that produces very little dynamic friction and, therefore, reduces power consumption of the compressor.

A still further advantage of the scroll compressor of the present invention is the provision of an axial compliance mechanism that is actuated after the compressor starts, thereby avoiding the high frictional forces on start-up associated with some axial compliance mechanisms.

The scroll compressor of the present invention, in one form thereof, provides a hermetically sealed housing including therein a discharge pressure chamber at discharge pressure and a suction pressure chamber at suction pressure. An oil sump is located within the discharge pressure chamber. A suction inlet is provided for conveying refrigerant fluid from outside of the housing to the suction pressure chamber. Likewise, a discharge outlet is provided for conveying refrigerant fluid from the discharge pressure chamber to the outside of the housing. A fixed scroll member is located within the housing and includes an involute fixed wrap element. A frame member is attached to the fixed scroll member, wherein the frame member and the fixed scroll member define the suction pressure chamber. The frame member includes a thrust surface, located within the suction pressure chamber, that faces the fixed scroll member. The thrust surface is in fixed spaced relationship with the fixed scroll member. Also included is an orbiting scroll member disposed axially intermediate the fixed scroll member and the thrust surface within the suction pressure chamber. The orbiting scroll member has a top surface including an involute orbiting wrap element thereon. The involute orbiting wrap element is intermeshed with the involute fixed wrap element. The orbiting scroll member further includes a bottom surface facing the thrust surface, and the orbiting scroll member is capable of axial movement toward the fixed scroll member in response to a compliance force acting on the orbiting scroll member bottom surface toward the fixed scroll member. The axial movement results in an axial space between the orbiting scroll member bottom surface and the thrust surface. A drive mechanism, including a rotatable crankshaft, causes the orbiting scroll member to orbit. The crankshaft is journalled in the frame member and includes a radially extending thrust plate disposed intermediate the orbiting scroll member bottom surface and the thrust surface. An eccentric crank portion extends upwardly from the top surface of the thrust plate and operatively engages the orbiting scroll member to impart orbiting motion thereto. An axial compliance mechanism provides the compliance force acting on the orbiting scroll member bottom surface. The axial compliance mechanism comprises a radially inner discharge pressure region and a radially outer suction pressure region. Oil is supplied from the oil sump to the discharge pressure region, whereby the oil in the oil sump is at substantially discharge pressure. A flexible annular seal element sealingly separates the discharge pressure region from the suction pressure region. The seal element is actuable by flow of oil from the discharge pressure region to the suction pressure region. The seal element is disposed intermediate the orbiting scroll member bottom surface and the thrust plate top surface, and includes a radially inner portion and a radially outer portion. The seal element is capable of flexing upon actuation thereof such that the radially inner and outer portions become axially offset to compensate for the axial space between the orbiting scroll member bottom surface and the thrust surface.

The invention further provides, in one form thereof, a method for substantially eliminating flow of fluid and establishing regions of high and low pressure within a gap defined by the back surface of an orbiting scroll member and a closely spaced thrust surface in a scroll compressor. In such an arrangement, there is flow of fluid within the gap caused by leakage from a high pressure region to a low pressure region within the compressor. The method, in accordance with the present invention, comprises the following steps. First, a flexible inner seal element is provided within the aforementioned axial gap. The seal element has a first portion and a second portion, and is capable of flexing such that the first and second portions become axially offset one from the other. Another step is to provide a seal groove within one of the back surface and the thrust surface, wherein the seal groove is adapted to receive the seal element. A further step is placing the seal element within the gap such that at least a portion of the seal element is received within the seal groove. The seal element is located within the gap such that the flow of fluid is from one to the other of the first and second portions of the seal element. Lastly, the method includes the step of actuating the seal element by flow of fluid such that the first and second portions of the seal element become axially offset. The seal element, when actuated, extends between and contacts the back surface and the thrust surface. The method of the present invention results in the flow of fluid being substantially eliminated, and the seal element sealingly separating between a high pressure region and a low pressure region within the gap.

DESCRIPTION OF THE PREFERRED EMBODIMENT

Figure 1:
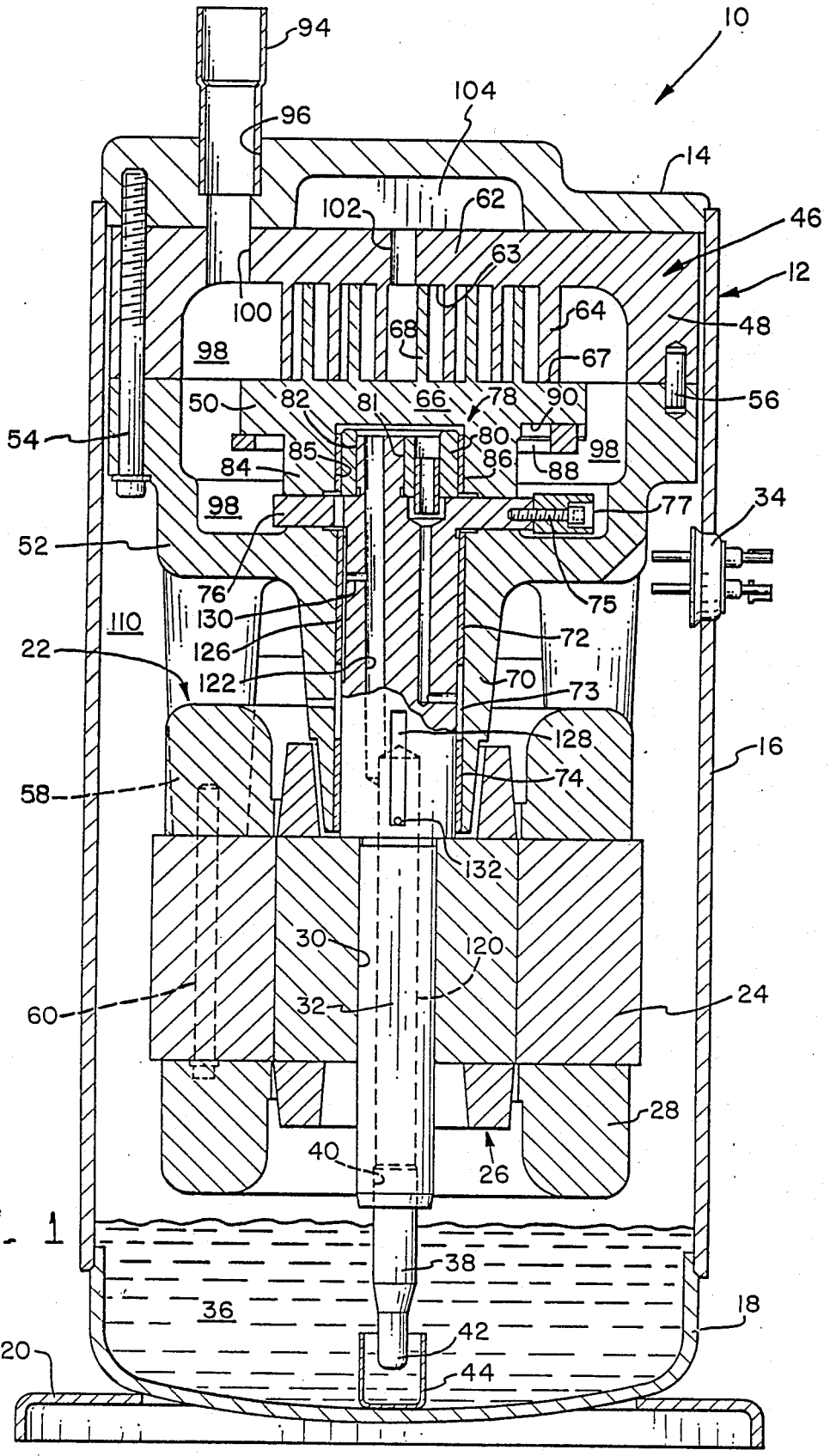
FIG. 1 is a longitudinal sectional view of a compressor of the type to which the present invention pertains, taken along the line 1—1 in FIG. 3 and viewed in the direction of the arrows.
Figure 2:
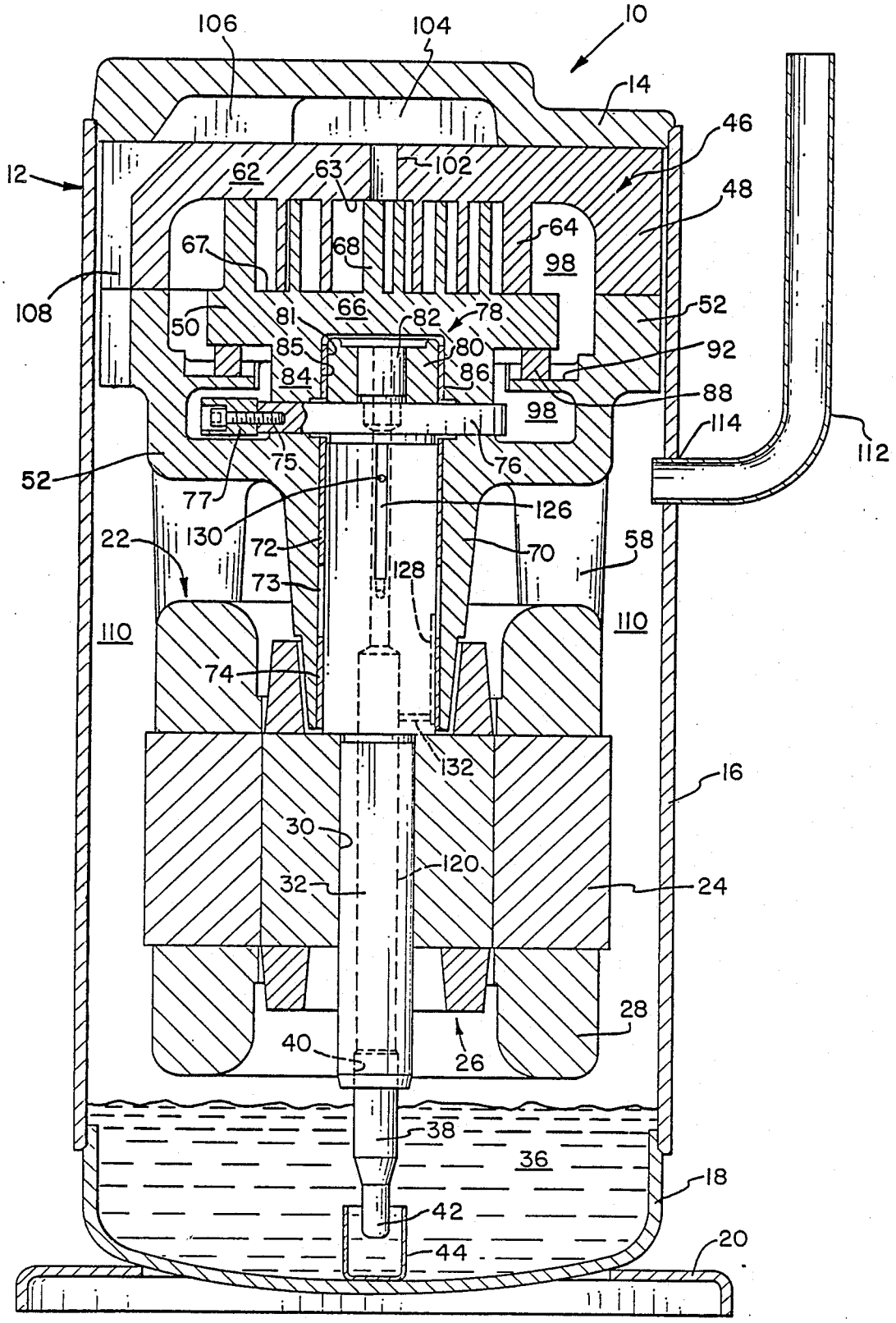
FIG. 2 is a longitudinal sectional view of the compressor of FIG. 1, taken along the line 2—2 in FIG. 3 and viewed in the direction of the arrows.
Figure 3:
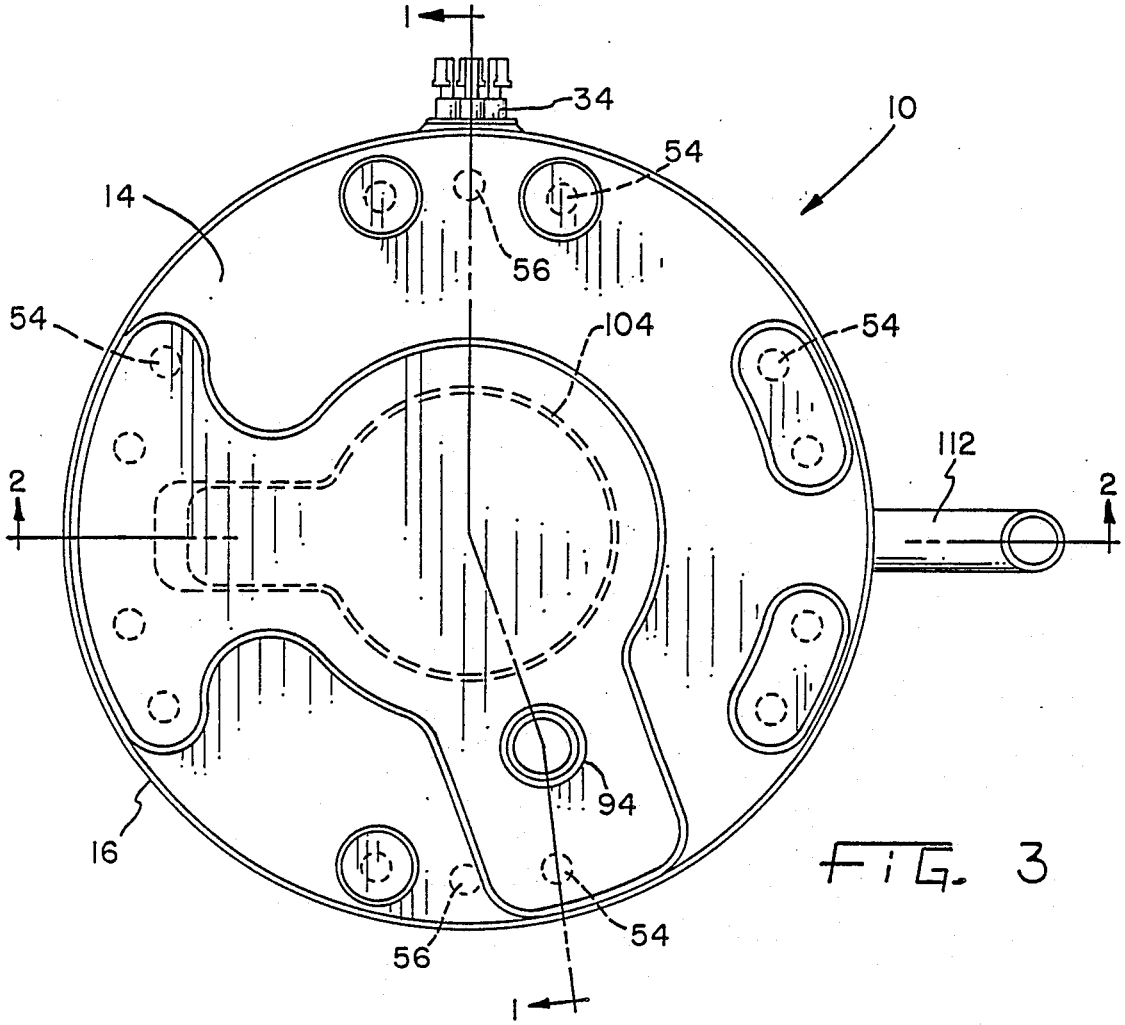
FIG. 3 is an enlarged top view of the compressor of FIG. 1.

In an exemplary embodiment of the invention as shown in the drawings, and in particular by referring to FIGS. 1-3, a compressor 10 is shown having a housing generally designated at 12. The housing has a top cover plate 14, a central portion 16, and a bottom portion 18, wherein central portion 16 and bottom portion 18 may alternatively comprise a unitary shell member. The three housing portions are hermetically secured together as by welding or brazing. A mounting flange 20 is welded to bottom portion 18 for mounting the compressor in a vertically upright position. Located within hermetically sealed housing 12 is an electric motor generally designated at 22, having a stator 24 and a rotor 26. Stator 24 is provided with windings 28. Rotor 26 has a central aperture 30 provided therein into which is secured a crankshaft 32 by an interference fit. A terminal cluster 34 is provided in central portion 16 of housing 12 for connecting motor 22 to a source of electric power.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein. An oil inlet end 42 of pickup tube 38 extends downwardly into the open end of a cylindrical oil cup 44, which provides a quiet zone from which high quality, non-agitated oil is drawn.

Compressor 10 includes a scroll compressor mechanism 46 enclosed within housing 12. Compressor mechanism 46 generally comprises a fixed scroll member 48, an orbiting scroll member 50, and a main bearing frame member 52. As shown in FIG. 1, fixed scroll member 48 and frame member 52 are secured together and are attached to top cover plate 14 by means of a plurality of mounting bolts 54. Precise alignment between fixed scroll member 48 and frame member 52 is accomplished by a pair of locating pins 56. Frame member 52 includes a plurality of mounting pads 58 to which motor stator 24 is attached by means of a plurality of mounting bolts 60, such that there is an annular gap between stator 24 and rotor 26.

Fixed scroll member 48 comprises a generally flat face plate 62 having a face surface 63, and an involute fixed wrap 64 extending axially from surface 63. Likewise, orbiting scroll member 50 comprises a generally flat face plate 66 having a top face surface 67, and an involute orbiting wrap 68 extending axially from surface 67. Fixed scroll member 48 and orbiting scroll member 50 are assembled together so that fixed wrap 64 and orbiting wrap 68 operatively interfit with each other. Furthermore face surfaces 63, 67 and wraps 64, 68 are manufactured or machined such that, during compressor operation when the fixed and orbiting scroll members are forced axially toward one another, the tips of wraps 64, 68 sealingly engage with respective opposite face surfaces 67, 63.

Main bearing frame member 52, as shown in FIGS. 1 and 2, comprises a downwardly extending bearing portion 70. Retained within bearing portion 70, as by press fitting, is a conventional sleeve bearing assembly comprising an upper bearing 72 and a lower bearing 74. Two sleeve bearings are preferred rather than a single longer sleeve bearing to facilitate easy assembly into bearing portion 70 and to provide an annular space 73 between the two bearings 72, 74. Accordingly, crankshaft 32 is rotatably journalled within bearings 72, 74.

Crankshaft 32 includes a concentric thrust plate 76 extending radially outwardly from the sidewall of crankshaft 32. A balance weight 77 is attached to thrust plate 76, as by bolts 75. Situated on the top of crankshaft 32 is an eccentric crank mechanism 78. According to a preferred embodiment, crank mechanism 78 comprises a cylindrical roller 80 having an axial bore 81 extending therethrough at an off-center location. An eccentric crankpin 82, constituting the upper, offset portion of crankshaft 32, is received within bore 81, whereby roller 80 is eccentrically journalled about eccentric crankpin 82. Orbiting scroll member 50 includes a lower hub portion 84 that defines a cylindrical well 85 into which roller 80 is received. Roller 80 is journalled for rotation within well 85 by means of a sleeve bearing 86, which is press fit into well 85. Each of sleeve bearings 72, 74, and 86 is preferably a steel-backed bronze bushing.

When crankshaft 32 is rotated by motor 22, the operation of eccentric crankpin 82 and roller 80 within well 85 causes orbiting scroll member 50 to orbit with respect to fixed scroll member 48. Roller 82 pivots slightly about crankpin 80 so that crank mechanism 78 functions as a conventional swing- link radial compliance mechanism to promote sealing engagement between fixed wrap 64 and orbiting wrap 68. Orbiting scroll member 50 is prevented from rotating about its own axis by means of a conventional Oldham ring assembly, comprising an Oldham ring 88, and Oldham key pairs 90, 92 associated with orbiting scroll member 50 and frame member 52, respectively.

In operation of compressor 10 of the preferred embodiment, refrigerant fluid at suction pressure is introduced through suction pipe 94, which is received within a counterbore 96 in top cover plate 14 and is attached thereto as by silver soldering or brazing. A suction pressure chamber 98 is generally defined by fixed scroll member 48 and frame member 52. Refrigerant is introduced into chamber 98 from suction tube 94 through a suction passageway 100 defined by aligned holes in top cover plate 14 and fixed scroll member 48. As orbiting scroll member 50 is caused to orbit, refrigerant fluid within suction pressure chamber 98 is compressed radially inwardly by moving closed pockets defined by fixed wrap 64 and orbiting wrap 68.

Refrigerant fluid at discharge pressure in the innermost pocket between the wraps is discharged upwardly through a discharge port 102 communicating through face plate 62 of fixed scroll member 48. Compressed refrigerant discharged through port 102 enters a discharge plenum chamber 104 defined by the underside of top cover plate 14. A radially extending duct 106 formed in top cover plate 14 and an axially extending duct 108 extending along the side of fixed scroll member 48 and frame member 52 allow the compressed refrigerant in discharge plenum chamber 104 to be introduced into housing chamber 110 defined within housing 12. As shown in FIG. 2, a discharge tube 112 extends through central portion 16 of housing 12 and is sealed thereat as by silver solder 114. Discharge tube 112 allows pressurized refrigerant within housing chamber 110 to be delivered to the refrigeration system (not shown) in which compressor 10 is incorporated.

Figure 4:
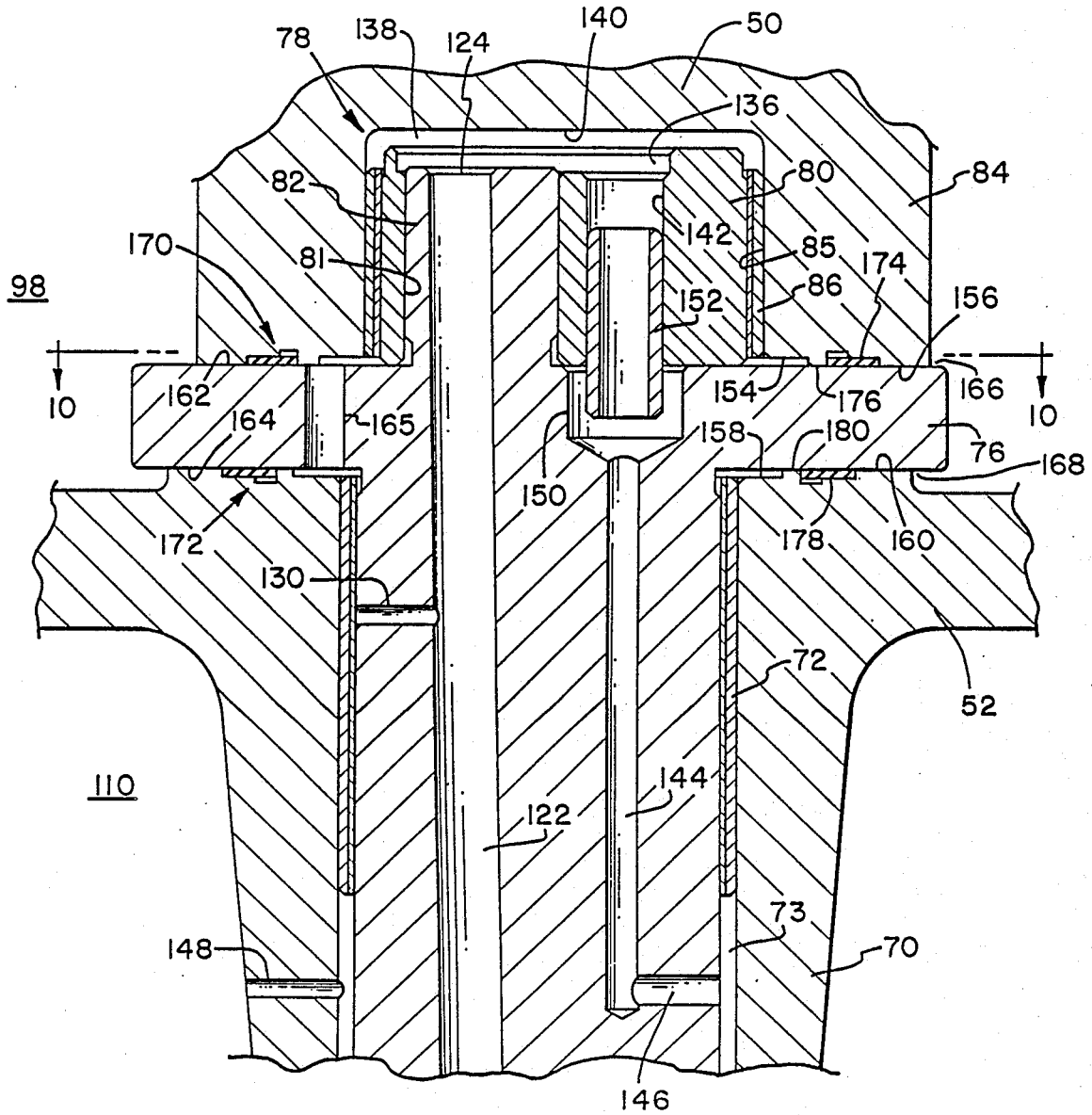
FIG. 4 is an enlarged fragmentary sectional view of the compressor of FIG. 1.

Reference will now be made to FIGS. 1, 2, and 4 for a general discussion of the lubrication system of compressor 10. An axial oil passageway 120 is provided in crankshaft 32, which communicates with tube 38 and extends upwardly along the central axis of crankshaft 32. At a central location along the length of crankshaft 32, an offset, radially divergent oil passageway 122 intersects passageway 120 and extends to an opening 124 on the top of eccentric crankpin 82 at the top of crankshaft 32. As crankshaft 32 rotates, oil pickup tube 38 draws lubricating oil from oil sump 36 and causes oil to move upwardly through oil passageways 120 and 122. As shown in FIGS. 1 and 2, lubrication of upper bearing 72 and lower bearing 74 is accomplished by means of flats 126 and 128 in crankshaft 32, located in the general vicinity of bearings 72 and 74, respectively. Flat 126 communicates with offset oil passageway 122 by means of a radial passage 130, while flat 128 communicates with axial oil passageway 120 by means of a radial passage 132. As illustrated in FIGS. 1 and 2, flats 126 and 128 extend axially along the length of crankshaft 32, and are located relative to bearings 72 and 74 so as to overlap and communicate with annular space 73.

Referring now to FIG. 4, lubricating oil pumped upwardly through offset oil passageway 122 exits crankshaft 32 through opening 124 located on the top of eccentric crankpin 82. A counterbore 136 in the top surface of roller 80 provides a reservoir into which oil from hole 124 is introduced. Lubricating oil within counterbore 136 will tend to flow downwardly along the interface between bore 81 and crankpin 82 for lubrication thereof. A flat on crankpin 82 (not shown) may be provided to enhance lubrication.

Lubrication delivered from hole 124 not only fills counterbore 136, but also fills a chamber 138 within well 85, defined by bottom surface 140 of well 85 and the top surface of crank mechanism 78, including roller 80 and crankpin 82. Oil within chamber 138 tends to flow downwardly along the interface between roller 80 and sleeve bearing 86 for lubrication thereof. A flat (not shown) may be provided in the outer cylindrical surface of roller 80 to enhance lubrication.

The lubrication system of compressor 10 further includes a vent for returning the oil that is pumped from sump 36 to counterbore 136 and chamber 138, back to sump 36. Specifically, an axially extending vent bore 142 is provided in roller 80, which provides communication between the top and bottom surfaces thereof. An axial vent passageway 144 extends axially through crankshaft 32 from the top surface of thrust plate 76 to a location along the length of crankshaft 32 adjacent annular space 73. A radial vent passageway 146 extends radially from axial passageway 144 to an outer surface of crankshaft 32 partially defining annular space 73. Furthermore, a vent hole 148 is provided through bearing portion 70 to provide communication between annular space 73 and housing chamber 110.

During venting of the lubrication system of compressor 10, lubricating oil is pumped upwardly through axial oil passageway 120 and offset oil passageway 122 by the operation of centrifugal oil pick-up tube 38. Upon leaving passageway 122 through opening 124, the oil collects in counterbore 136 and chamber 138 and is also vented downwardly through vent bore 142. Vent bore 142 is generally aligned with the upper portion of axial vent passageway 144 at the interface between roller 80 and thrust plate 76. Therefore, oil flowing downwardly through vent bore 142 continues to flow through vent passageway 144, and then radially outwardly into annular space 73 through radial vent passageway 146. Oil contained within annular space 73, whether deposited there as the result of venting or as the result of the previously described lubrication of bearing 72 and 74, is metered back into housing chamber 110 through vent hole 148.

As discussed previously with respect to the swing-link radial compliance mechanism of the preferred embodiment, roller 80 pivots slightly with respect to crankpin 82 to effect radial compliance of orbiting scroll member 50 against fixed scroll member 48. Accordingly, in order to maintain generally aligned communication between vent bore 142 and axial vent passageway 144, the upper portion of passageway 144 adjacent the top surface of thrust plate 76 comprises a pocket 150 having a diameter greater than that of vent bore 142. In this manner, roller 80 may experience limited pivotal motion while maintaining fluid communication between vent bore 142 and axial vent passageway 144. As shown in FIG. 4, a hollow roll pin 152 is press fit into vent bore 142 and extends from the bottom of roller 80 into the void defined by pocket 150. Oil may continue to flow through roll pin 152 to maintain fluid communication between vent bore 142 and axial passageway 144, however, roller 80 is restrained from pivoting completely about crankpin 82. This restraint against pivoting is used primarily during assembly to keep roller 80 within a range of positions to ensure easy assembly of orbiting scroll member 50 and fixed scroll member 48.

Referring now to FIG. 4 for a description of the axial compliance mechanism of compressor 10 in accordance with a preferred embodiment of the present invention, lubricating oil at discharge pressure is provided by the aforementioned lubrication system to the underside of orbiting scroll member 50 within well 85 thereof. More specifically, when the lubricating oil fills chamber 138, an upward force acts upon orbiting scroll member 50 toward fixed scroll member 48. The magnitude of the upward force is determined by the surface area of bottom surface 140. In order to increase the upward force on orbiting scroll member 50, a shallow counterbore 154 is provided in a bottom surface 156 of orbiting scroll member 50 immediately adjacent, i.e., circumjacent, the opening of well 85. Counterbore 154 provides additional surface area on bottom surface 156 to which lubricating oil at discharge pressure may be exposed to create an upward force on orbiting scroll member 50.

In order to keep the forces acting on crankshaft 32 essentially at equilibrium, i.e., exposing the top and bottom of the crankshaft to the same pressures, a counterbore 158 is provided in a top thrust surface 160 of main bearing frame member 52 immediately adjacent, i.e., circumjacent, the opening of bearing portion 70. In this manner, equal areas of a top surface 162 and a bottom surface 164 of thrust plate 76 are exposed to the lubricating oil at discharge pressure within counterbore 154 and counterbore 158, respectively. Additionally, a pressure equalization port 165 may be provided in thrust plate 76 to insure that the oil within counterbores 154 and 158 is at the same pressure. Port 165 extends between top surface 162 and bottom surface 164 and provides communication between counterbores 154 and 158.

For proper operation of the axial compliance mechanism of the present invention, the lubricating oil at discharge pressure within counterbores 154, 158 is sealingly separated from suction pressure chamber 98, located radially outwardly therefrom. More specifically, seals are provided within a top interface 166 defined by top surface 162 and bottom surface 156, and within a bottom interface 168 defined by bottom surface 164 and top surface 160, respectively. The particular seals of the present invention are actuable by flow of oil, or oil and refrigerant fluid, radially outwardly from counterbores 154, 158, as will be described hereinafter.

As previously described, fixed scroll member 48 and frame member 52 are secured together and define suction chamber 98 in which orbiting scroll member 50 is operably disposed. In the preferred embodiment of the invention, top surface 160 is spaced a fixed distance from fixed scroll member 48 such that orbiting scroll member 50 and thrust plate 76 are capable of limited axial movement of approximately 0.018 inches. Accordingly, when an axial compliance force causes orbiting scroll member 50 to move upwardly toward fixed scroll member 48, an axial space results intermediate bottom surface 156 and top surface 160. Therefore, it is necessary that seals be provided within top interface 166 and bottom interface 168 that compensate for the resulting axial space.

Figure 5:
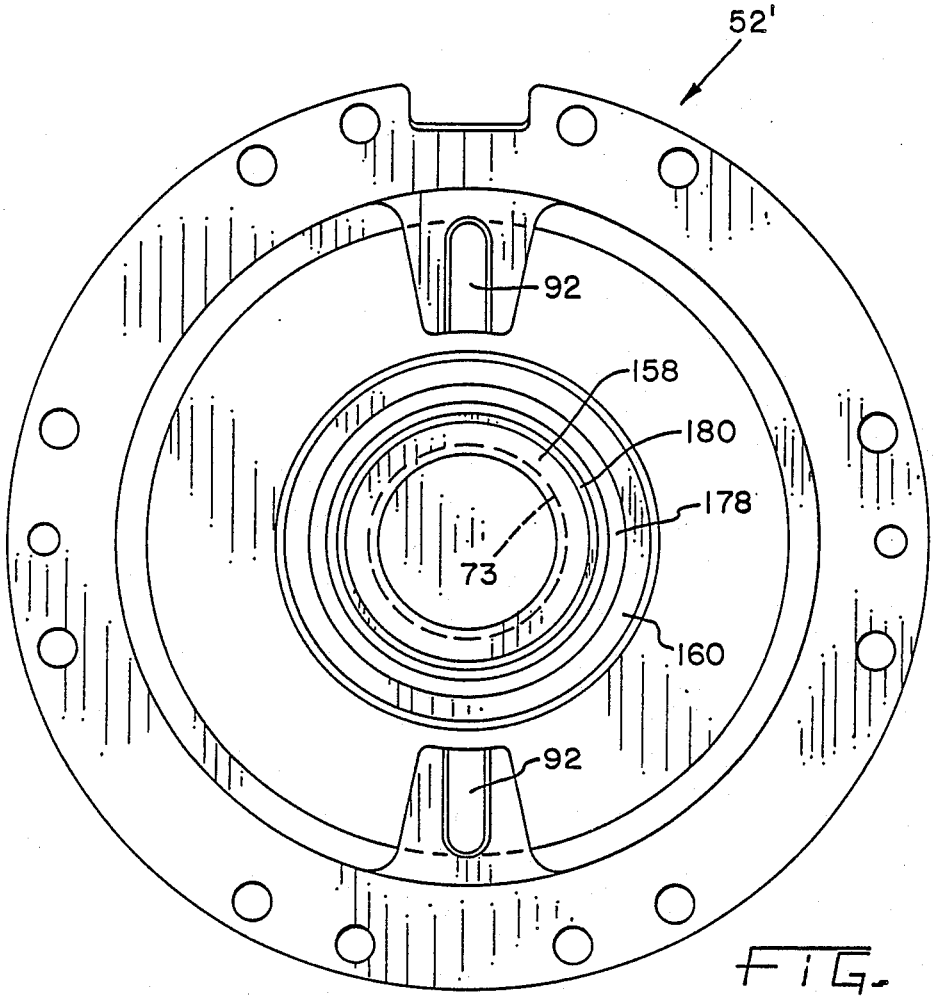
FIG. 5 is an enlarged top view of the main bearing frame member of the compressor of FIG. 1.
Figure 6:
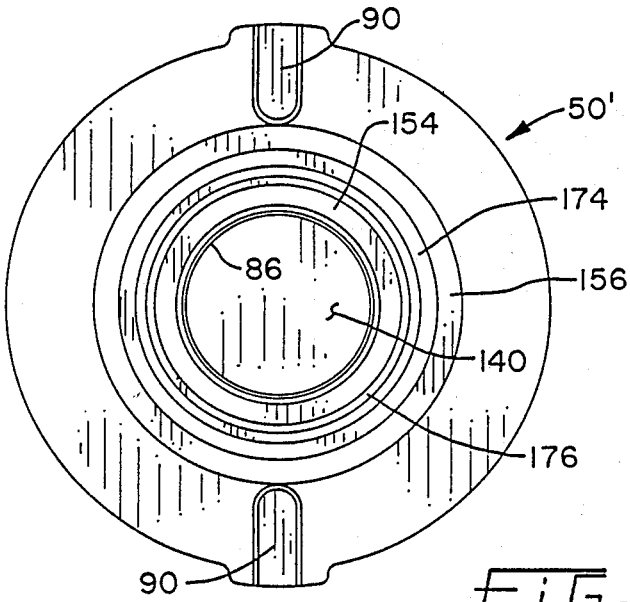
FIG. 6 is an enlarged bottom view of the orbiting scroll member of the compressor of FIG. 1.

Referring now to FIG. 4, a top seal assembly 170 and a bottom seal assembly 172 are provided within top interface 166 and bottom interface 168, respectively, to substantially seal between counterbores 154 and 158 containing oil at discharge pressure, and suction pressure chamber 98 located radially outwardly of top and bottom interfaces 166 and 168. As shown in FIGS. 4 and 6, orbiting scroll member 50 includes an annular stepped seal groove 174 formed within bottom surface 156, as by milling. An annular land 176 is radially disposed between counterbore 154 and stepped seal groove 174. Similarly, a stepped seal groove 178 is formed in top surface 160 of frame member 52, as shown in FIGS. 4 and 5. An annular land portion 180 is radially disposed between counterbore 158 and seal groove 178.

Figure 7:
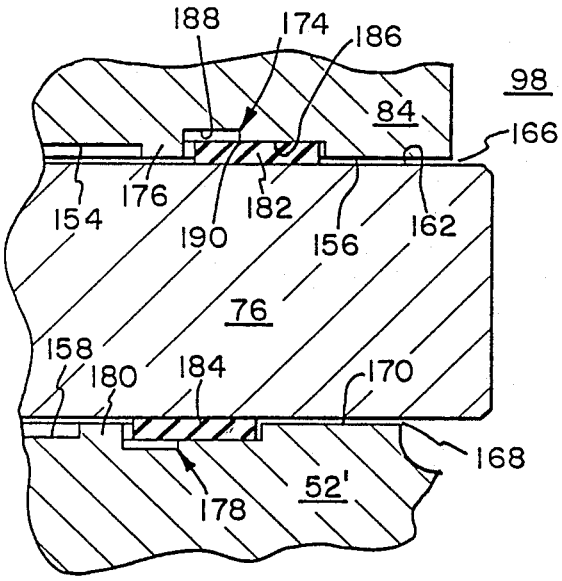
FIG. 7 is an enlarged fragmentary sectional view of the compressor of FIG. 1, particularly showing the annular seal element in a non-actuated state.
Figure 8:
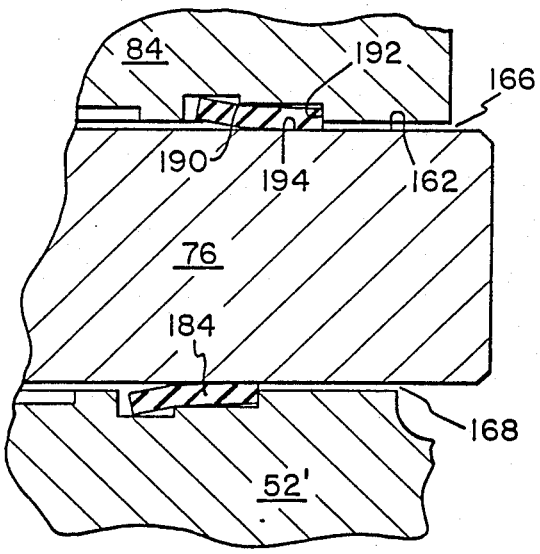
FIG. 8 is an enlarged fragmentary sectional view of the compressor of FIG. 1, particularly showing the annular seal element in an actuated state.

Referring now to FIGS. 7 and 8, an annular seal element 182 is disposed within top seal groove 174, and an annular seal element 184 is disposed within bottom seal groove 178. In the preferred embodiment, the axial depth of seal grooves 174, 178 and the thickness of seal elements 182, 184 are such that each seal element extends axially out of its respective groove approximately 0.006 inches, thereby leaving a 0.006 inch axial space, as previously described. Reference will now be made to top seal groove 174 and annular seal element 182 for a detailed description of top seal assembly 170. The foregoing discussion is equally applicable to bottom seal assembly 172, which is a mirror image of top seal assembly 170.

Referring once again to FIGS. 7 and 8, top seal groove 174 includes a shallow channel portion 186, a deep channel portion 188, and a ledge portion 190 disposed therebetween. When compressor 10 is assembled and at rest, seal element 182 is in a flat non-actuated state, as shown in FIG. 7. However, when compressor 10 starts, lubricating oil at discharge pressure within counterbore 154 begins moving radially outwardly within top interface 166. Initially, the oil flows radially outwardly around both the top and bottom surfaces of seal element 182. Seal 182 is flexingly actuated when the channeling effect of the oil flow between seal element 182 and seal groove 174 causes seal element 182 to be forced there against. Furthermore, the radially innermost portion of seal element 182 continues to move into deep channel portion 188, thereby causing seal element 182 to pivot about ledge portion 190, as shown in FIG. 8. At the same time, seal element 182, due to the pressure differential between the oil at discharge pressure within counterbore 154 and suction pressure chamber 98, is forced radially outwardly along top interface 166. Accordingly, as shown in FIG. 8, the primary points of sealing contact for seal element 182 are the pivot point at ledge 190, a radially outermost sidewall 192 of seal groove 174, and an annular seal contacting region 194 of top surface 162 of thrust plate 76.

Figure 9:
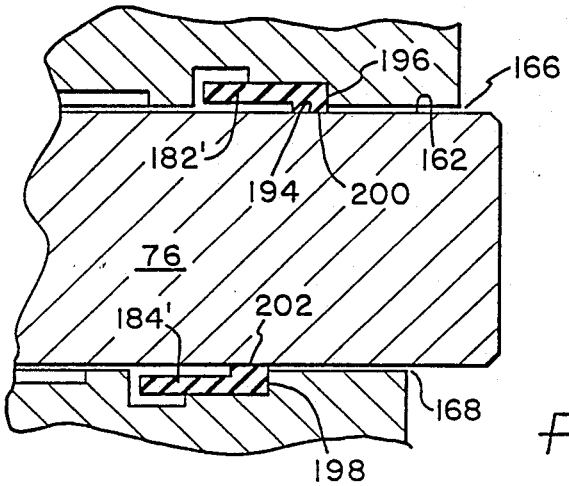
FIG. 9 is an enlarged fragmentary sectional view of the compressor of FIG. 1, particularly showing an alternative embodiment of the annular seal element.

FIG. 9 illustrates an alternative embodiment of annular seal elements 182 and 184, wherein seal elements 182′ and 184′ include an L-shaped cross-sectional configuration. More specifically, respective axial projections 196 and 198 provide seals 182′ and 184′ with contacting surfaces 200 and 202, respectively. The operation of seal elements 182′ and 184′ is similar to that of seal elements 182 and 184 already described. However, the provision of contacting surfaces 200 and 202 allows the total contacting area of annular seal contacting region to be less than that experienced with flat sealing elements 182 and 184. Accordingly, lower friction is experienced during operation of the compressor according to the alternative embodiment of the annular seal elements, as shown in FIG. 9.

Figure 10:
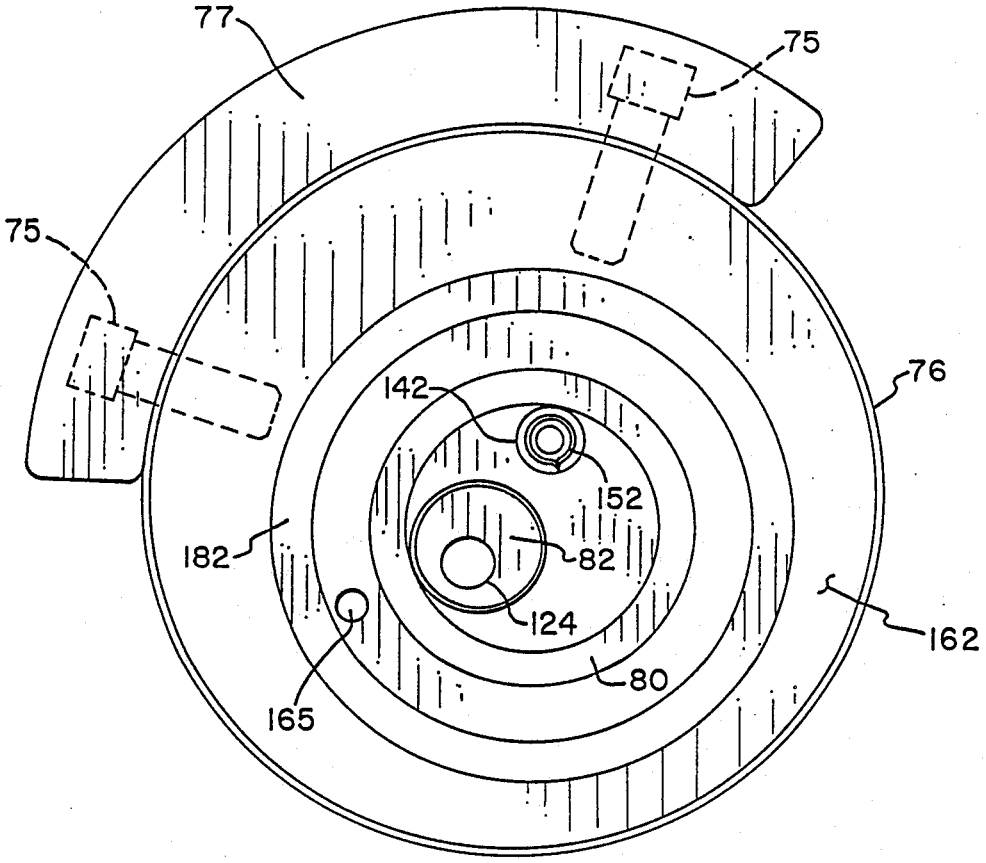
FIG. 10 is an enlarged fragmentary sectional view of the compressor of FIG. 1, taken along the line 10—10 in FIG. 4 and viewed in the direction of the arrows, particularly showing the location of the top annular seal on the top surface of the crankshaft thrust plate.

FIG. 10 illustrates the concentric orientation of annular seal element 184 on top surface 162 of thrust plate 76, with respect to roller 80. More specifically, pressure equalization port 165 is shown radially positioned between annular seal element 182 and roller 80, so as to retain lubricating oil at discharge pressure radially inward from top seal assembly 170.

The annular seal elements disclosed herein are preferably composed of a Teflon material. More specifically, a glassfilled Teflon, or a mixture of Teflon, Carbon, and Ryton is preferred in order to provide the seal element with the necessary rigidity to resist extruding into clearances due to pressure differentials. Furthermore, the surfaces against which the Teflon seals contact are preferably bronze.

Describing the operation of the axial compliance mechanism in accordance with the present invention, an axial space exists between the orbiting wrap tips of the orbiting scroll member and the face plate of the fixed scroll member when the compressor is initially at rest. When the compressor first starts, some leakage occurs at the interface between the scroll members, however, some compression occurs which begins pressurizing the discharge chamber within the housing. At the same time, the centrifugal oil pump delivers oil through the crankshaft bearings to the radially inner discharge pressure regions intermediate the orbiting scroll member and the frame thrust surface. Oil within the discharge pressure regions not only provides an axial compliance force, but also flows radially outwardly therefrom toward the suction pressure chamber so as to actuate the annular seals.

It will be appreciated that several operational advantages, particularly at compressor start-up, result from the axial compliance mechanism of the present invention. For example, because the seals are actuated by oil that is first used to lubricate crankshaft bearings, the bearings are lubricated prior to any significant load being placed on the crankshaft, thus increasing bearing life. Furthermore, the oil-actuated seals permit oil to initially leak to the scroll wraps for lubrication thereof prior to axial compliance of the orbiting scroll member against the fixed scroll member. Finally, the actuated seals ride on a thin oil film, thereby permitting higher compressor operating speeds without causing damage to the seals.

It will be appreciated that the foregoing description of various embodiments of the invention is presented by way of illustration only and not by way of any limitation, and that various alternatives and modifications may be made to the illustrated embodiments without departing from the spirit and scope of the invention.

What is claimed is:

1. A scroll compressor for compressing refrigerant fluid, comprising:

a fixed scroll member including an involute fixed wrap element;

an orbiting scroll member including a plate portion having a face surface and a back surface, said face surface having an involute orbiting wrap element thereon, said fixed and orbiting wrap elements being intermeshed to define at least one pocket of refrigerant fluid compressed by orbiting motion of said orbiting scroll member with respect to said fixed scroll member;

a thrust surface adjacent said orbiting scroll member back surface and spaced therefrom to define an axial gap therebetween;

a region of discharge pressure and a region of suction pressure, said regions of discharge and suction pressure establishing a pressure differential across said gap, said pressure differential initially causing flow of an actuating fluid within said gap;

seal means, actuable by said initial flow of actuating fluid, for establishing and sealingly separating said region of discharge pressure and said region of suction pressure within said gap, said seal means comprising a flexible annular seal element disposed within said gap, said seal element having a radially inner portion and a radially outer portion and being capable of flexing upon actuation of said seal means such that said radially inner and outer portions become axially offset; and means in said gap for restraining said radially outer portion of said seal element against radially outward movement, whereby said seal element is permitted to flex.

2. The scroll compressor of claim 1 in which:

said orbiting scroll member back surface includes an annular seal groove in which said seal element is partially disposed.

3. The scroll compressor of claim 2 in which:

said radially outer portion of said seal element includes a projection extending axially toward said thrust surface, said projection having a contact surface facing said thrust surface.

4. The scroll compressor of claim 2 in which:

said seal groove includes a radially inner groove portion and a radially outer groove portion, said radially inner groove portion having greater axial depth than said radially outer groove portion.

5. The scroll compressor of claim 4 in which:

said seal element has an axial thickness greater than the axial depth of said radially outer groove portion.

6. The scroll compressor of claim 1, and further comprising:

drive means, including a rotatable crankshaft, for causing said orbiting scroll member to orbit, said crankshaft having a radially extending thrust plate disposed axially intermediate said orbiting scroll member and said thrust surface, said discharge and suction pressure regions being disposed intermediate said orbiting scroll member bottom surface and a top surface of said thrust plate.

7. The scroll compressor of claim 1, and further comprising:

a hermetically sealed housing in which said previously cited elements are enclosed, said housing including a discharge pressure chamber therein; and an oil sump within said discharge pressure chamber, wherein said actuating fluid comprises oil from said oil sump.

8. A scroll compressor, comprising:

a fixed scroll member including an involute fixed wrap element;

a frame member attached to said fixed scroll member, said frame member including a thrust surface facing said fixed scroll member, said thrust surface being in fixed spaced relationship with said fixed scroll member;

an orbiting scroll member disposed axially intermediate said fixed scroll member and said thrust surface, said orbiting scroll member having a top surface and including an involute orbiting wrap element on said top surface, said involute orbiting wrap element being intermeshed with said involute fixed wrap element, said orbiting scroll member including a bottom surface facing said thrust surface, said orbiting scroll member being capable of axial movement toward said fixed scroll member in response to a compliance force acting on said orbiting scroll member bottom surface toward said fixed scroll member;

drive means for causing said orbiting scroll member to orbit, said drive means including a rotatable crankshaft journalled in said frame member, said crankshaft including a radially extending thrust plate disposed intermediate said orbiting scroll member and said thrust surface;

axial compliance means for providing said compliance force to act on said orbiting scroll member bottom surface, said compliance means comprising a radially inner discharge pressure region and a radially outer suction pressure region, said discharge and suction pressure regions being disposed intermediate said orbiting scroll member bottom surface and said thrust surface;

means for supplying oil to said discharge pressure region;

seal means, actuable by flow of oil from said discharge pressure region to said suction pressure region, for sealingly separating said discharge pressure region from said suction pressure region, said seal means comprising a flexible annular seal element disposed between said thrust plate and one of said orbiting scroll member bottom surface and said frame member thrust surface, said seal element having a radially inner portion and a radially outer portion and being capable of flexing upon actuation of said seal means such that said radially inner and outer portions become axially offset to compensate for said axial movement of said orbiting scroll member; and means for restraining said radially outer portion of said seal element against radially outward movement, whereby said seal element is permitted to flex.

9. The scroll compressor of claim 8, and further comprising:

a hermetically sealed housing in which said previously cited elements are enclosed, said housing including a discharge pressure chamber therein; and an oil sump within said discharge pressure chamber, wherein said means for supplying oil to said discharge pressure region supplies oil from said oil sump.

10. A scroll compressor for compressing refrigerant fluid, comprising:

a hermetically sealed housing including therein a discharge pressure chamber at discharge pressure and a suction pressure chamber at suction pressure;

an oil sump within said discharge pressure chamber;

suction inlet means for conveying refrigerant fluid from outside of said housing to said suction pressure chamber;

discharge outlet means for conveying refrigerant fluid from said discharge pressure chamber to outside of said housing;

a fixed scroll member within said housing including an involute fixed wrap element;

a frame member attached to said fixed scroll member, said frame member and said fixed scroll member defining said suction pressure chamber, said frame member including within said suction pressure chamber a thrust surface facing said fixed scroll member, said thrust surface being in fixed spaced relationship with said fixed scroll member;

an orbiting scroll member disposed axially intermediate said fixed scroll member and said thrust surface within said suction pressure chamber, said orbiting scroll member having a top surface and including an involute orbiting wrap element on said top surface, said involute orbiting wrap element, said orbiting scroll member including a bottom surface facing said thrust surface, said orbiting scroll member being capable of axial movement toward said fixed scroll member in response to a compliance force acting on said orbiting scroll member bottom surface toward said fixed scroll member;

drive means for causing said orbiting scroll member to orbit, said drive means including a rotatable crankshaft journalled is said frame member, said crankshaft including a radially extending thrust plate disposed intermediate said orbiting scroll member bottom surface and said thrust surface, and an eccentric crank portion extending upwardly from a top surface of said thrust plate, said crank portion operatively engaging said orbiting scroll member to impart orbiting motion thereto;

axial compliance means for providing said compliance force to act on said orbiting scroll member bottom surface, said compliance means comprising a radially inner discharge pressure region and a radially outer suction pressure region;

means for supplying oil from said oil sump to said discharge pressure region, said oil from said oil sump being at substantially discharge pressure;

seal means, actuable by flow of oil from said discharge pressure region to said suction pressure region, for sealingly separating said discharge pressure region from said suction pressure region, said seal means comprising a flexible annular seal element disposed intermediate said orbiting scroll member bottom surface and said thrust plate top surface, said seal element having a radially inner portion and a radially outer portion and being capable of flexing upon actuation of said seal means such that said radially inner and outer portions become axially offset to compensate for axial movement of said orbiting scroll member; and means for restraining said radially outer portions of said seal element against radially outward movement, whereby said seal element is permitted to flex.

11. The scroll compressor of claim 10 in which:
one of said orbiting scroll member bottom surface and said thrust plate top surface includes an annular seal groove in which said seal element is partially disposed.

12. The scroll compressor of claim 11 in which:
said radially outer portion of said seal element includes a projection extending axially toward said thrust plate top surface, said projection having a contact surface facing said thrust plate top surface.

13. The scroll compressor of claim 11 in which:
said seal groove includes a radially inner step portion of a uniform deep depth, an adjacent radially outer step portion of a uniform shallow depth, and an axial ledge portion therebetween the radial dimension of said seal element being such that said seal element is radially disposed within said seal groove and extends across said ledge portion.

14. The scroll compressor of claim 11 in which said seal element is of Teflon material.

15. The scroll compressor of claim 14 in which:
said orbiting scroll member bottom surface and said thrust plate top surface are of bronze material.

16. The scroll compressor of claim 10 in which:
said crankshaft has a lower pump end disposed within said oil sump and an upper delivery end adjacent said crank portion, said crankshaft including an axial oil passageway extending from said lower pump end to said upper delivery end for conveying oil from said oil sump to said discharge pressure region.

17. The scroll compressor of claim 16 in which:
said means for supplying oil from said oil sump to said discharge pressure region comprises said crankshaft, wherein said oil conveyed through said axial oil passageway to said upper delivery end lubricates said crank portion before being supplied to said discharge pressure region.

18. The scroll compressor of claim 16 in which:
said lower pump end of said crankshaft comprises a centrifugal oil pump operable upon rotation of said crankshaft.

19. A scroll compressor for compressing refrigerant fluid, comprising:
a hermetically sealed housing including therein a discharge pressure chamber at discharge pressure and a suction pressure chamber at suction pressure;
an oil sump within said discharge pressure chamber:
suction inlet means for conveying refrigerant fluid from outside of said housing to said suction pressure chamber;
discharge outlet means for conveying refrigerant fluid from said discharge pressure chamber to outside of said housing;
a fixed scroll member within said housing including an involute fixed wrap element;
a frame member attached to said fixed scroll member, said frame member and said fixed scroll member defining said suction pressure chamber, said frame member including within said suction pressure chamber a thrust surface facing said fixed scroll member, said thrust surface being in fixed spaced relationship with said fixed scroll member;
an orbiting scroll member disposed axially intermediate said fixed scroll member and said thrust surface within said suction pressure chamber, said orbiting scroll member having a top surface and including an involute orbiting wrap element on said top surface, said involute orbiting wrap element being intermeshed with said involute fixed wrap element, said orbiting scroll member including a bottom surface facing said thrust surface, said orbiting scroll member being capable of axial movement toward said fixed scroll member in response to a compliance force acting on said orbiting scroll member bottom surface toward said fixed scroll member, said axial movement resulting in an axial space between said orbiting scroll member bottom surface and said thrust surface;
a rotatable crankshaft having an eccentric crank portion, a shaft portion, and a radially extending plate portion between said crank portion and said shaft portion, said plate portion being disposed intermediate said orbiting scroll member bottom surface and said thrust surface, said crank portion extending upwardly from a top surface of said plate portion and being operatively engaged with said orbiting scroll member to impart orbiting motion thereto when said crankshaft is rotated, said orbiting scroll member bottom surface being adjacent said plate portion top surface to establish a top interface therebetween, and said plate portion having a bottom surface adjacent said thrust surface to establish a bottom interface therebetween;
axial compliance means for providing said compliance force to act on said orbiting scroll member bottom surface, said compliance means comprising a radially inner discharge pressure region and a radially outer suction pressure region within each of said top and bottom interfaces;
means for supplying oil from said oil sump to said top interface discharge pressure region and said bottom interface discharge pressure region such that said oil supplied from said oil sump lubricates said crank portion and said shaft portion;
seal means, actuable by radially outward flow of oil from said discharge pressure region to said suction pressure region within each of said respective top and bottom interfaces, for sealingly separating said discharge pressure region from said suction pressure region, said seal means comprising a flexible annular seal element disposed within each of said respective top and bottom interfaces, each said seal element having a radially inner portion and a radially outer portion, each said seal element being capable of flexing upon actuation of said seal means such that said radially inner and outer portions become axially offset to compensate for said axial space between said orbiting scroll member bottom surface and said thrust surface; and
means in each of said respective top and bottom interfaces for restraining said radially outer portion of each said respective seal element against radially outward movement, whereby each said respective seal element is permitted to flex.

20. The scroll compressor of claim 19 in which:
said orbiting scroll member bottom surface and said thrust plate top surface each include an annular seal groove in which a respective said seal element is partially disposed.

21. The scroll compressor of claim 17 in which:
said radially outer portion of each of said seal elements rides against said plate portion with an oil film therebetween.

22. The scroll compressor of claim 20 in which:

said radially outer portion of each said seal element includes a projection extending axially toward said plate portion, said projection having a contact surface facing said plate portion.

23. The scroll compressor of claim 20 in which:

each said seal groove includes a radially inner groove portion and a radially outer groove portion, said radially inner groove portion having greater axial depth than said radially outer groove portion.

24. The scroll compressor of claim 19 in which:

said frame member includes a main bearing in which said shaft portion is journalled;

said orbiting scroll member includes a crank bearing in which said crank portion is journalled;

said crankshaft has a lower pump end disposed within said oil sump and an upper delivery end, said crankshaft including an axial oil passageway extending from said lower pump end to said upper delivery end and containing oil from said oil pump; and said means for supplying oil comprises said crankshaft, means for conveying oil from said axial oil passageway to said top interface discharge pressure region such that said crank bearing is first lubricated, and means for conveying oil from said axial oil passageway to said bottom interface discharge pressure region such that said main bearing is first lubricated.

25. The scroll compressor of claim 24 in which:

said lower pump end of said crankshaft comprises a centrifugal oil pump operable upon rotation of said crankshaft to pump oil upwardly into said axial oil passageway.

26. The scroll compressor of claim 19 in which:

said radially outer portion of each of said seal elements rides against said plate portion with an oil film therebetween.

27. In a scroll compressor comprising fixed and orbiting scroll members operably intermeshed to compress refrigerant fluid, wherein said orbiting scroll member includes a back surface, said back surface being adjacent a thrust surface and spaced therefrom to define an axial gap therebetween, there being flow of fluid within said gap caused by leakage from a high pressure region to a low pressure region of the compressor, a method for substantially eliminating said flow of fluid and establishing regions of high and low pressure within said gap, comprising the steps of:

providing a flexible planar seal element within said axial gap, said seal element having a first portion and a second portion and being capable of flexing such that said first and second portions become axially offset one from the other;

providing a seal groove within one of said back surface and said thrust surface, said seal groove being adapted to receive said seal element;

placing said seal element within said gap such that at least a portion of said seal element is received within said seal groove, said seal element being located within said gap such that said flow of fluid is from one to the other of said first and second portions of said seal element, said seal groove restraining movement of the other of said first and second portions in the direction of said flow of fluid; and actuating said seal element by said flow of fluid such that said first and second portions become axially offset, said seal element when actuated extending between and contacting said back surface and said thrust surface, whereby said flow of fluid is substantially eliminated and said seal element sealingly separates between a high pressure region and a low pressure region within said gap.

28. The method of claim 27 in which:

said seal element and said seal groove are annular, said first and second portions comprising radially inner and outer portions of said annular seal element, respectively.

29. The method of claim 28 in which:

said seal groove includes a radially inner groove portion and a radially outer groove portion, said radially inner groove portion having greater axial depth than said radially outer groove portion.

30. The method of claim 29 in which:

said seal element has an axial thickness greater than the axial depth of said radially outer groove portion.

31. The method of claim 27, wherein said scroll compressor is within a hermetically sealed housing having an oil sump, in which:

said step of actuating said seal element is by flow of fluid comprising oil from said oil sump.

32. The method of claim 31, wherein said scroll compressor includes a centrifugal oil pump, in which:

said flow of fluid comprising oil is supplied by said centrifugal oil pump upon start-up of said compressor.

33. The method of claim 32, wherein said compressor includes a crankshaft journalled within at least one bearing, in which:

said flow of fluid comprising oil lubricates said bearing prior to actuating said seal element.

* * * * *

UNITED STATES PATENT AND TRADEMARK OFFICE

CERTIFICATE OF CORRECTION

PATENT NO. : 4,884,955

DATED : December 5, 1989

INVENTOR(S) : Hubert Richardson, Jr.

It is certified that error appears in the above-identified patent and that said Letters Patent is hereby corrected as shown below:

Claim 10, Col. 14, line 27, after "element" and before the comma, insert --being intermeshed with said involute fixed wrap element--;

Claim 24, Col. 17, line 19, change "pump" to --sump--.

Signed and Sealed this

Twenty-second Day of January, 1991

*Attest:*

*Attesting Officer*

HARRY F. MANBECK, JR.

*Commissioner of Patents and Trademarks*